United States Patent [19]

Warwicker

[11] Patent Number: 4,611,711

[45] Date of Patent: Sep. 16, 1986

[54] CASH BOX

[75] Inventor: Clive W. Warwicker, Cookley, Nr. Kidderminster, United Kingdom

[73] Assignee: Helix Limited, West Midlands, England

[21] Appl. No.: 775,157

[22] Filed: Sep. 12, 1985

[30] Foreign Application Priority Data

Mar. 12, 1985 [GB] United Kingdom ..... 8506405

[51] Int. Cl.[4] ..... A45C 11/28

[52] U.S. Cl. ..... 206/0.81; 206/561; 220/22

[58] Field of Search ..... 220/22, 23.83; 206/0.8, 206/0.81, 0.83, 0.84, 561, 564, 565, 372; 109/53; 312/293

[56] References Cited

U.S. PATENT DOCUMENTS

| | | | |
|---|---|---|---|
| 2,522,768 | 9/1950 | Wiepert | 206/561 |
| 2,804,197 | 8/1957 | Popkess et al. | 206/0.81 |
| 3,429,425 | 2/1969 | Hebert | 206/0.81 |

*Primary Examiner*—George T. Hall

*Attorney, Agent, or Firm*—Becker & Becker, Inc.

[57] ABSTRACT

A cash box which is of rectangular shape, and comprises a top lid part and a bottom receptacle part of similar shape and depth which are hinged together at the back. The bottom part supports a coin-receiving tray having an outwardly-extending flanged rim, which seats on the top edge or lip of the bottom part and provides a seal between the two parts. This flanged rim is also adapted to cover the joint between the lid and bottom part when the cash box is closed. A lock unit is fitted in a recessed portion of the top panel of the lid part, which also accommodates a pivoted carrying handle. The lock has a locking plate that cooperates with an abutment provided by an upstanding post, which is secured to the bottom receptacle part and which passes through an aperture in the coin-receiving tray. The structure disclosed facilitates economical manufacture of a compact cash box with an efficient utilization of storage space.

14 Claims, 7 Drawing Figures

CASH BOX

BACKGROUND OF THE INVENTION

The present invention relates to cash boxes, especially cash boxes of a small portable kind, which are commonly used for holding and segregating coins and notes.

An object of the present invention is to provide an improved construction of cash box, which can be manufactured very economically, and which can include various useful practical features affording a high degree of convenience and security to the user. A further object of the present invention is to provide a cash box which can also present attractive styling features.

Many constructions of cash boxes are known, but, generally, they comprise a body shell having a relatively deep receptacle part and a shallow hinged lid, which closes onto a shoulder or ledge around a recessed lip portion of the receptacle part. These known cash boxes are lockable by means of a lock on the front wall of the body shell, while a shallow partitioned coin tray is fitted and contained wholly within the receptacle part, so as to rest on internal ledges or lugs, thereby leaving space beneath for containing notes.

BRIEF DESCRIPTION OF THE DRAWINGS

These and other objects and advantages of the present invention will appear more clearly from the following specification in conjunction with the accompanying drawings, in which.

SUMMARY OF THE INVENTION

Figure 1:
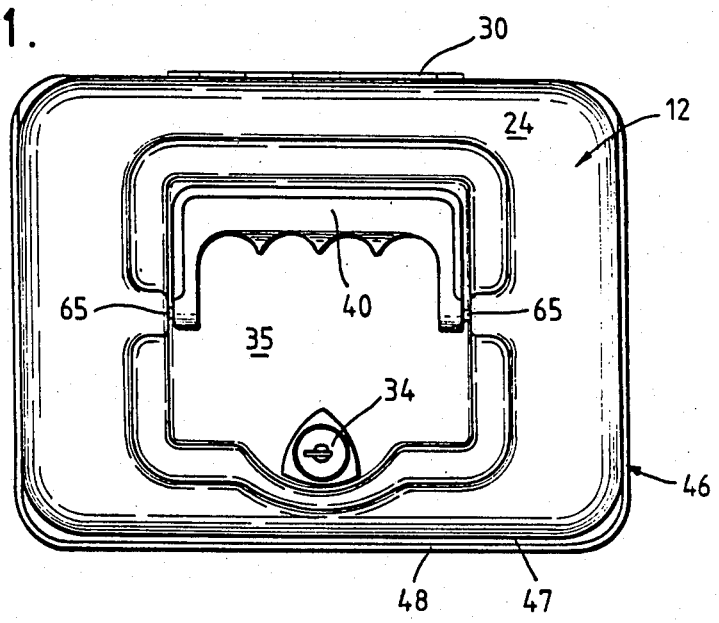
FIG. 1 is a plan view of one inventive embodiment of the cash box in a closed condition.
Figure 2:
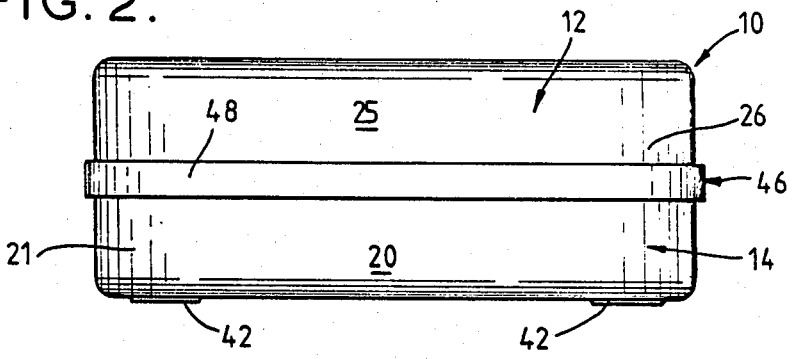
FIG. 2 is a front elevational view.
Figure 3:
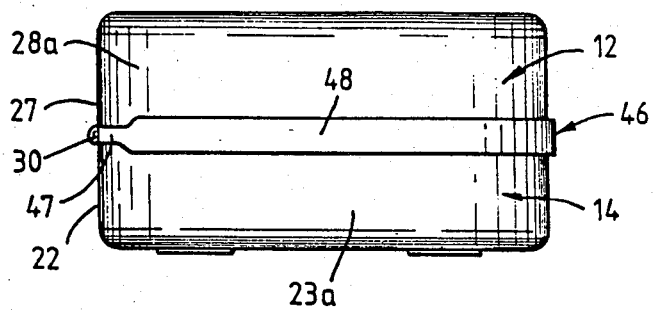
FIG. 3 is a side elevational view.

According to the present invention, there is provided a cash box having a body shell comprising complementary hollow top and bottom parts, a lid part, and a receptacle part respectively, which are hinged together along rear edges The inventive cash box is also provided with a locking mechanism for locking the cash box in the closed condition In addition, the inventive cash box has an internal coin tray, which is formed with peripheral wall portions and with partition walls to provide a plurality of open-topped coin-receiving compartments. The coin tray is supported in use by the bottom receptacle part, so that said coin-receiving compartments extend upwardly into, and are accommodated at least partially within, the lid part when the cash box is closed. The lid part is formed by a top panel portion, which has a continuous depending peripheral wall, and which mounts a carrying handle, while the bottom receptacle part is formed by a base portion having a continuous upstanding peripheral wall The locking mechanism is operable from the top of the cash box, and comprises a lock unit which is fitted to the top panel of the lid part for operating an internal locking member that is arranged to engage and co-operate with a complementary abutment means provided by the bottom receptacle part.

This structure facilitates designing the cash box so as to provide a most efficient utilization of storage space. In preferred embodiments, the coin tray has an outwardly extending rim around its periphery, which is adapted to seat on the upper edge of the peripheral wall of the bottom receptacle part. This upper edge constitutes a lip which bounds the mouth of the bottom receptacle part. The rim of the coin tray also engages against the lower edge of the depending peripheral wall of the lid part. When the cash box is closed, this lower edge constitutes a lip bounding the mouth of the lid part, so that in such closed condition, the rim provides a seal interposed between the two parts of the body shell.

The above construction permits both the lip of the bottom part and the lip of the top part to be provided by a plain free edge of the respective boundary walls, without any beading or recessing, to form an abutment shoulder or ledge. The dimensions of the mouth of the bottom receptacle part may be identical with those of the mouth of the top lid part. Preferably, the bottom receptacle part and the top lid part are both of substantially rectangular shape, and are also of substantially the same depth; both are advantageously made as metal pressings from identical blanks. Not only does this facilitate manufacture, but it also enables the cash box to be designed to open through a 180° angle, with the top and bottom parts lying substantially flat. In this open and flat condition, the coin tray, even if weighted down heavily with coins, can be tranferred temporarily to rest in a stable relationship on the top lid part, while access is gained to notes or other items lying within the bottom receptacle part.

Also, in the preferred embodiments, the rim of the coin tray provides a vertically oriented flange, which lies externally of the top and bottom parts, and covers the joint therebetween, at least along the front and around the sides, when the box is closed. This may be achieved by forming the rim with a T-shaped cross-section, so that the cross-bar of the "T" section provides the vertically oriented flange.

With the lock unit fitted to the top of the lid part, the problem of arranging the complementary abutment means provided by the bottom part, so that it can be accommodated without interfering with the positioning of the coin tray and without need for any interruption of the continuity of the rim of the coin tray, may be conveniently overcome by designing the abutment means in the form of an elongate abutment carrying member, for example a post. This carrying member is secured within the lower section of the bottom receptacle part, and extends upwardly through an aperture in the body of the coin tray into the upper lid part for co-operative engagement with the locking member which is operated by the lock unit.

Preferably, the top panel of the lid part has a sunken recessed portion, in which is mounted both the lock unit and the carrying handle; the latter being conveniently of a generally wide U-shape configuration pivotally mounted by trunnion bearings in pivot holes which are formed in the side walls of the sunken recessed portion, and are arranged to fold flat within the sunken recessed portion when not in use Also, the top lid part and the coin tray may advantageously be profiled and dimensioned so that, when the cash box is closed, the lid part covers and substantially seals at least some of said compartments of the coin tray, so that coins in such closed compartments cannot be accidentally transferred to other compartments if the box should be overturned.

DESCRIPTION OF PREFERRED EMBODIMENTS

The cash box illustrated in the drawings is of generally rectangular shape with smooth rounded corners, and comprises a body shell 10 made up of complementary top and bottom parts, 12 and 14 respectively. A tray 16, which is partitioned to provide a number of separate open-topped coin-receiving compartments 18*a*, 18*b*, *18c*, etc. forms an internal fitment of the body shell 10.

The top and bottom parts 12 and 14 are fabricated as sheet metal pressings from identical blanks, both having similar dimensions with substantially the same overall general rectangular shape and the same depth. The bottom part 14 has a base portion 19, and a continuous peripheral wall 20 comprising a front wall portion 21, a back wall portion 22, and opposite side wall portions 23*a*, 23*b*. The top or lid part 12 has a top panel portion 24 and a continuous peripheral wall 25 which comprises a front wall portion 26, a back wall portion 27, and opposite side wall portions 28*a*, 28*b*. The two parts 12 and 14 are hingedly connected together by a pin and sleeve leaf hinge fitment 30, which is secured to their back wall portions.

It will be noted that the walls 20 and 25 of the top and bottom parts 12 and 14 each terminate in a plain free edge defining a lip 31 or 32, without any beading or recessed ledge formations, thereby simplifying the manufacturing operation.

Also, it will be seen that the hinge fitment 30 permits relative movement of the top and bottom parts 12 and 14 through a 180° angle, and in the fully open condition, by virtue of both parts having the same depth, they lie substantially flat in side-by-side relationship in a common plane, and each may be supported at least to some extent by an underlying flat supporting surface.

Figure 4:
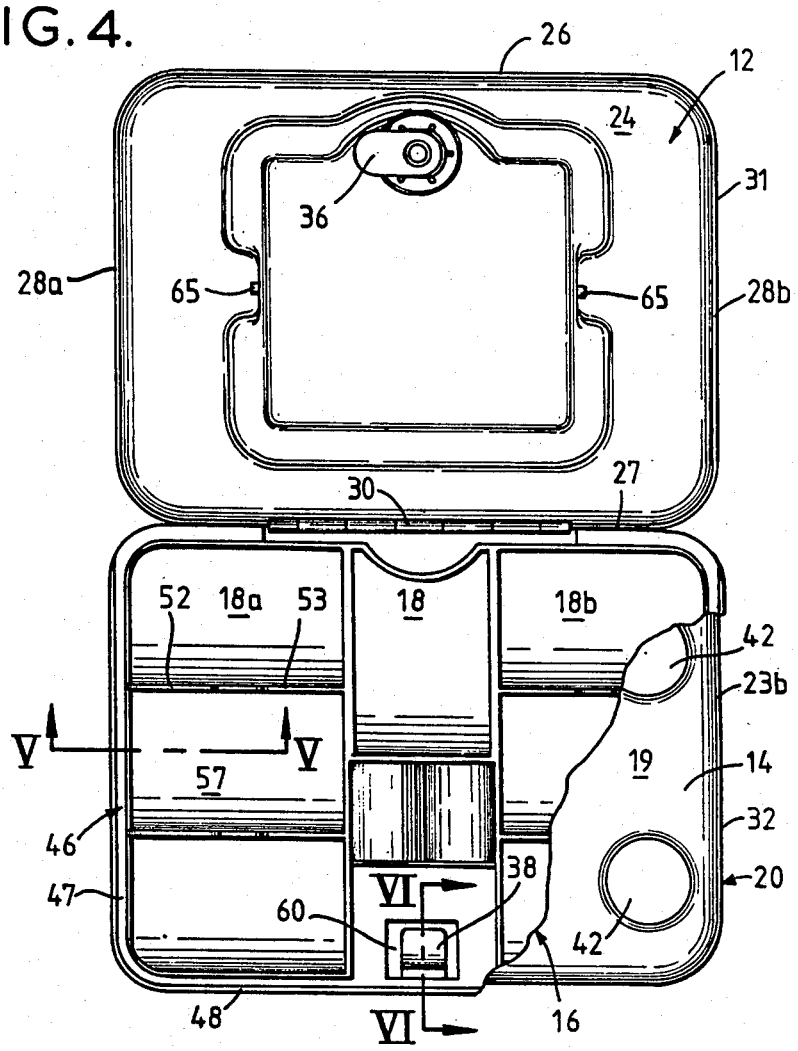
FIG. 4 is a plan view of the cash box in an open condition with part of the internal coin tray broken away.
Figure 6:
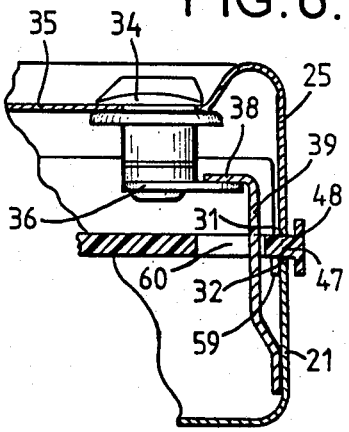

The bottom part 14 normally supports the coin tray 16, as hereinafter described, and provides the main cash receptacle, while the top part 12 provides a lid fitted with a carrying handle 40. When closed, the cash box can be locked by a key-operated cylinder lock 34, that is mounted in a sunken recessed portion 35 of the top panel 24 of the lid part 12. This lock 34 operates a locking plate 36, which turns in a horisontal plane to engage with a locking detent lug 38, @providing abutment means carried integrally by an upstanding post 39, which is secured at its lower end to the interior face of the front wall portion 21 of the lower part 14. As shown in FIGS. 4 and 6, this abutment carrier post 39 extends upwardly through an aperture 60 in the body of the coin tray 16 and into the lid part 12.

The carrying handle 40, which is fitted to the lid part, is conveniently of a wide U-shaped configuration formed as an injection molding of hard plastics material; and it is pivotally mounted, so as to fold flat in the recessed portion 35. This is conveniently arranged by providing the side limbs with outwardly directed trunnion projections 65, which engage in pivot holes in the side walls of the sunken recessed portion 35, as indicated in the drawings.

The base 19 of the bottom part 14 is also conveniently formed with a number of very shallow depressions 42, providing bearing pads or feet standing slightly proud from the bottom exterior surface.

The coin tray 16 is a plastics molding, and is formed with a rim 46 comprising an outwardly extending peripheral rib 47, which is adapted to seat directly on the lip 32 of the bottom part 14 of the cash box, thereby supporting the tray. As the rib 47 of the rim 46 extends outwardly over the lip 32, it is thus also engaged on its upper surface by the lip 31 of the upper lid part 12 when the cash box is closed, forming, in effect, a seal interposed between the two parts of the body shell 10.

At the back of the tray, the rim 46 provided by the rib 47 is formed with a gap to accommodate the hinge fitment 30, but along the front and at the two opposite sides, the rim 46 has a T-shaped cross-section with the rib portion 47 terminating in an outer vertically disposed flange 48. In the closed condition of the cash box, this flange 48 appears as a broad band covering the joint between the top and bottom parts, thereby providing an attractive decorative feature and, at the same time, reducing the possibilities for forcing a levering tool into the joint to break open the box. Since this flange 48 projects somewhat beyond the external surface of the wall portions of the box, it also provides a convenient additional gripping element which can facilitate handling of the box. At the front, the tray 16, in this embodiment, is also provided with integral, depending, locating lugs 59 which engage the inside face of the front wall portion 21 of the bottom receptacle part 14 to limit movement of the tray when it is properly seated in place.

Figure 5:
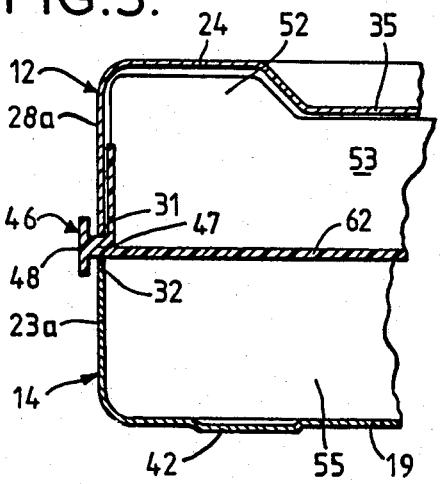
FIGS. 5 and 6 are fragmentary sectional views on lines V—V and VI—VI respectively of FIG. 4, but with the box closed.

The coin-receiving compartments 18*a*, 18*b*, etc. are defined by peripheral wall portions and partitions wall portions of the tray 16 which extend upwards above the level of the rim 46, so that these compartments lie above the mouth of the bottom receptacle part 14 and, when the box is closed, are accommodated substantially entirely within the hollow interior of the top lid part 12. The open tops of the coin compartments are also substantially closed or sealed by the close proximity of the underside of the top panel 24, thereby preventing or reducing the possibility of any coins escaping from the individual compartments should the box be overturned. In order to accommodate the recessed portion 35 of the top panel 24, it will be noted that some of the partitions between compartments are specially profiled along their upper edge (see, for example, upper edge portion 52 of partition 53 shown in FIG. 5).

The form of coin receiving tray in this embodiment is particularly easy to handle and, since the coin compartments lie mainly within the top lid part, the bottom receptacle part requires less depth than would otherwise be the case to provide adequate space below the tray (as shown at 55 in FIG. 5) for storage of notes and other items.

The coin compartments are each closed by a bottom wall forming part of a substantially flat base 62 of the tray 16, and internally this bottom wall is advantageously smoothly curved upwardly at the front, e.g. at 57, to facilitate scooping out coins.

It will be seen that, in this embodiment, the compartments 18*a*, 18*b*, 18*c*, etc. are arranged in two groups of three at each side of the tray, with an intermediate rear compartment 18*c* in between. In front of the intermediate compartment in the center, the tray has a pair of shallow recesses and, adjacent the front edge, as previously mentioned, the aperture 60 gives clearance for the locking detent abutment carrier post 39 (see FIG. 6).

Figure 7:
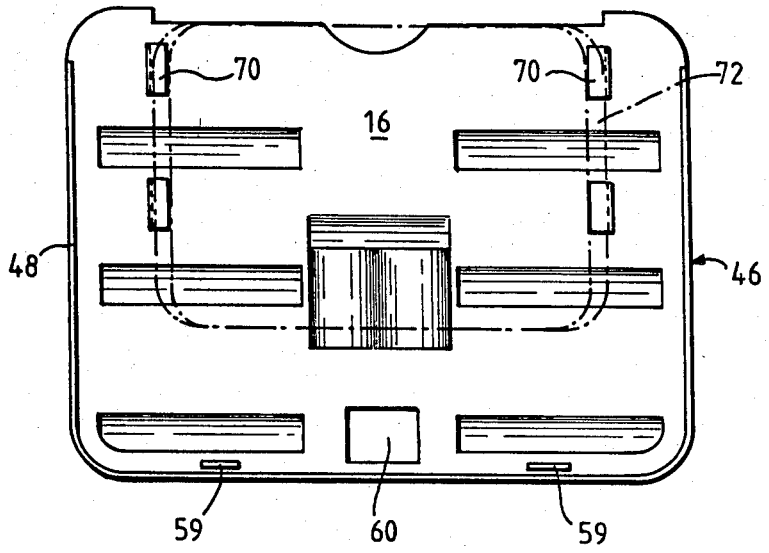
FIG. 7 is an underside plan view of the coin tray.

Other arrangements of the coin-receiving pockets are, of course, possible, and may be determined by the particular size and capacity of the cash box. For some larger sizes, the tray may also be provided with additional supporting legs (not shown), which are adapted to ensure that the coin tray remains level when removed and placed on a flat surface outside the box. Also, as indicated in FIG. 7, the coin tray may be formed on its underside with lugs or channels 70, thereby providing guides for fitting a concealed shallow sliding supplementary tray or drawer 72, openable only when the coin tray is removed from the box. Notes, checks, or flat cards, for example, may be accommodated in this tray or drawer 72. Additional supporting legs, such as are referred to above, can also be useful when the supplementary tray or drawer 72 is provided, in order to ensure that it is kept clear of an underneath supporting surface when the main coin tray is removed from the box. In the absence of the supplementary tray or drawer 72, notes and other loose items will usually be stored within the bottom receptacle part 14 in the space 55 below the coin tray, and, when access is required, the tray will be tilted or temporarily removed. As previously indicated, a particularly convenient feature of the construction herein described is that, after opening the box out flat, the coin tray 16 can be simply lifted off the bottom receptacle part 14 and rested temporarily in stable relationship on the upturned top lid part 12.

The present invention is, of course, in no way restricted to the specific disclosure of the specification and drawings, but also encompasses any modifications within the scope of the appended claims.

What I claim is:

1. A cash box comprising:

a lid part having a panel portion and a continuous peripheral wall connected thereto;

a bottom receptacle part having a base portion and a continuous peripheral wall, with said lid part and said bottom receptacle part forming complementary hollow parts of said cash box; said bottom receptacle part also having a lock abutment means;

hinge means hingedly interconnecting said lid part and said bottom receptacle to permit relative movement thereof between a closed and an open position;

a carrying handle mounted on said panel portion of said lid part;

a locking mechanism for locking said cash box in said closed position; said locking mechanism includes a lock unit mounted to said panel portion of said lid part, and a locking member operatively connected to said lock unit and movable relative thereto for selectively engaging and disengaging said lock abutment means of said bottom receptacle part, thereby providing for locking and unlocking of said cash box;

a coin tray which is positioned within said cash box, and which has cooperating peripheral walls and partition walls providing a plurality of open-topped coin-receiving compartments; and edge support means provided on said bottom receptacle part to support said coin tray in such a way that said coin receiving compartments thereof are accommodated at least partially within said lid part when said cash box is in said closed position.

2. A cash box according to claim 1, wherein said coin tray has an outwardly extending rim around said peripheral walls thereof, said rim being adapted to seat on said peripheral wall of said bottom receptacle part, and to engage against said peripheral wall of said lid part when said cash box is in said closed position, so that in said closed position said rim of said coin tray provides a seal interposed between said two parts of said cash box.

3. A cash box according to claim 2, wherein the circumference of said peripheral walls of said lid part and said bottom receptacle part are substantially the same.

4. A cash box according to claim 2, wherein said rim of said coin tray is provided with a flange which extends beyond said lid part and said bottom receptacle part and is disposed therebetween when said cash box is in said closed position.

5. A cash box according to claim 4, wherein said rim of said coin tray has a substantially T-shaped cross-section throughout at least a major portion of its peripheral extent, with the cross bar of said "T" section forming said flange and extending parallel to said peripheral walls of said lid part and said bottom receptacle part.

6. A cash box according to claim 2, wherein said lid part and said bottom receptacle part are each of rectangular shape, with their respective peripheral walls extending in common planes when said cash box is in said closed position, both of said parts being fabricated as metal pressings from identical blanks and both having substantially the same depth.

7. A cash box according to claim 1, wherein said lock abutment means of said bottom receptacle part comprises an elongate lock abutment carrier member which extends upwardly through an aperture in said coin tray and into said lid part.

8. A cash box according to claim 1, wherein said lock unit is mounted in a sunken recessed portion. provided in said panel portion of said lid part.

9. A cash box according to claim 8, wherein said carrying handle is also mounted in said sunken recessed portion of said panel portion of said lid part and is pivotable so as to fold flat within said recessed portion when not in use.

10. A cash box according to claim 9, wherein said carrying handle is U-shaped, having side arms which terminate in outwardly directed trunnion projections arranged to engage within pivot holes formed in side walls of said sunken recessed portion.

11. A cash box according to claim 2, wherein said peripheral walls and said partition walls of said coin tray which define at least some of said coinreceiving compartments lie in close proximity to a side of said panel portion of said lid part remote from said carrying handle when said cash box is in said closed position, so that said lid part substantially closes off at least some of said compartments thereby preventing accidental transfer of coins between different compartments if said cash box should be overturned.

12. A cash box according to claim 2, wherein said coin-receiving compartments of said coin tray lie substantially entirely above the level of said bottom receptacle part when said tray is in position supported on said bottom receptacle part.

13. A cash box according to claim 1, wherein said coin tray has a substantially flat surface provided with means for fitting a supplementary slidable tray on that side thereof remote from said coinreceiving compartments.

14. A cash box according to claim 1, wherein said coin tray is provided with additional supporting legs arranged so as to rest upon a flat surface when said coin tray is removed from said cash box.

* * * * *